US008561352B2

(12) United States Patent
Vogler

(10) Patent No.: US 8,561,352 B2
(45) Date of Patent: Oct. 22, 2013

(54) SLIDING DOOR

(75) Inventor: Thomas Vogler, Bad Salzuflen (DE)

(73) Assignee: Dorma GmbH + Co. KG, Ennepetal (DE)

( * ) Notice: Subject to any disclaimer, the term of this patent is extended or adjusted under 35 U.S.C. 154(b) by 72 days.

(21) Appl. No.: 13/139,483

(22) PCT Filed: Dec. 10, 2009

(86) PCT No.: PCT/EP2009/008844

§ 371 (c)(1),
(2), (4) Date: Jun. 13, 2011

(87) PCT Pub. No.: WO2010/066431

PCT Pub. Date: Jun. 17, 2010

(65) Prior Publication Data

US 2011/0252596 A1 Oct. 20, 2011

(30) Foreign Application Priority Data

Dec. 12, 2008 (DE) ..... 10 2008 061 731

(51) Int. Cl.
*E05F 3/22* (2006.01)

(52) U.S. Cl.
USPC ..... 49/409; 49/138

(58) Field of Classification Search
USPC ..... 49/409, 410, 138; 16/82, 86 B, 49; 312/138.1, 139, 319.1; 220/254.9, 220/345.1, 348, 345.4
See application file for complete search history.

(56) References Cited

U.S. PATENT DOCUMENTS

| | | | | |
|---|---|---|---|---|
| 3,040,372 | A * | 6/1962 | Ellis | 16/62 |
| 4,429,492 | A * | 2/1984 | Imhoff | 49/367 |
| 4,656,781 | A * | 4/1987 | Niekrasz et al. | 49/404 |
| 4,872,239 | A * | 10/1989 | Ferguson et al. | 16/64 |
| 5,313,739 | A * | 5/1994 | Nelson et al. | 49/404 |
| 5,426,820 | A * | 6/1995 | Coleman et al. | 16/85 |
| 5,450,651 | A * | 9/1995 | Coleman et al. | 16/82 |
| 5,829,508 | A * | 11/1998 | DeBower et al. | 160/371 |
| 6,487,752 | B1 * | 12/2002 | Mathews | 16/86 B |
| 6,629,738 | B2 * | 10/2003 | Salice | 312/333 |
| 7,077,487 | B2 * | 7/2006 | Yang | 312/333 |
| 7,356,878 | B2 * | 4/2008 | Foster | 16/71 |
| 7,393,068 | B2 * | 7/2008 | Sato et al. | 312/333 |
| 7,886,403 | B2 * | 2/2011 | Nezu et al. | 16/87 R |
| 8,052,232 | B1 * | 11/2011 | Chen | 312/319.1 |
| 8,060,983 | B2 * | 11/2011 | Bortoluzzi | 16/85 |

(Continued)

FOREIGN PATENT DOCUMENTS

| | | |
|---|---|---|
| DE | 102008009046 | 9/2009 |
| EP | 1953319 | 8/2008 |

(Continued)

*Primary Examiner* — Katherine Mitchell
*Assistant Examiner* — Justin Rephann
(74) *Attorney, Agent, or Firm* — Cozen O'Connor

(57) ABSTRACT

A sliding door with a door leaf, which is suspended from at least one carriage and guided to be displaceable along a roller rail profile disposed at a wall or at a ceiling. The sliding door includes a closing device, which is suitable to displace the door leaf into a closed position in a decelerated manner. The closing device is disposed at the door leaf and includes a first and a second spring-damper element, which are disposed to be counter-directional to each other. The second spring-damper element is suitable to displace the door leaf into an open position in a decelerated manner.

10 Claims, 3 Drawing Sheets

(56) References Cited

U.S. PATENT DOCUMENTS

| | | | | |
|---|---|---|---|---|
| 8,235,478 | B2 * | 8/2012 | Zimmer et al. | 312/333 |
| 2003/0234604 | A1 * | 12/2003 | Lin | 312/334.6 |
| 2006/0016279 | A1 * | 1/2006 | Sato et al. | 74/89.17 |
| 2006/0017359 | A1 | 1/2006 | Sato et al. | |
| 2007/0101539 | A1 * | 5/2007 | Sutterlutti et al. | 16/49 |
| 2007/0186481 | A1 * | 8/2007 | Tomita et al. | 49/409 |
| 2007/0188060 | A1 * | 8/2007 | Nussbaumer et al. | 312/333 |
| 2008/0244862 | A1 * | 10/2008 | Tooyama | 16/82 |
| 2008/0302020 | A1 * | 12/2008 | Gosling et al. | 49/427 |
| 2009/0230830 | A1 * | 9/2009 | Ng | 312/333 |
| 2009/0273129 | A1 * | 11/2009 | Zimmer et al. | 267/170 |
| 2010/0043172 | A1 | 2/2010 | Nezu et al. | |
| 2011/0023370 | A1 | 2/2011 | Zimmer et al. | |
| 2011/0167588 | A1 * | 7/2011 | Chang et al. | 16/71 |
| 2011/0175508 | A1 * | 7/2011 | Rechberg et al. | 312/334.8 |

FOREIGN PATENT DOCUMENTS

| | | |
|---|---|---|
| EP | 2101022 | 9/2009 |
| JP | 2008157010 | 7/2008 |
| JP | 2008297861 | 12/2008 |

* cited by examiner

SLIDING DOOR

PRIORITY CLAIM

This is a U.S. national stage of Application No. PCT/EP2009/008844, filed on Dec. 10, 2009, which claims priority to German Application No: 10 2008 061 731.8, filed: Dec. 12, 2008, the contents of which are incorporated herein by reference.

BACKGROUND OF THE INVENTION

1. Field of the Invention

The present invention relates to a sliding door with a door leaf suspended from at least one carriage guided to be displaceable along a roller rail profile that is disposed at a wall or at a ceiling, the sliding door having a closing device that is suitable to displace the door leaf into a closed position in a decelerated manner.

2. Related Art

The problem with sliding doors is that very often the doors, when being carelessly opened or closed, impact on a limit stop; this can be very loud, but can also destroy a door, such as a glass sliding door. If the sliding door is closed with too much momentum, it will often bounce against the limit stop, which can only absorb a portion of the energy, such that the sliding door bounces back and remains in a not completely closed position. Closing devices are known for this purpose that displace the sliding door into a final position and simultaneously achieve a damping effect.

When opening a sliding door with too much momentum, this results very often in the problem that the first user is able to easily pass the door after having triggered the opening operation, but the sliding door simultaneously returns into the partially closed position, and the following user of the sliding door bumps with his shoulder or side into the door; whereby, on the one hand, a risk of injury is given and, on the other hand, the sliding door will start to swing perpendicularly to the opening direction and thus may be prone to damage.

SUMMARY OF THE INVENTION

It is an object of one embodiment of the invention to provide a sliding door, in which a closing device achieves a displacement into a terminal position and simultaneously a damping effect for both, the opening operation and the closing operation. In this case, the closing device should be as compact as possible, and should be retrofittable to existing sliding doors.

In one embodiment of the invention the closing device is disposed at the door leaf and includes a first and a second spring-damper element, which are disposed to be counter-directional to each other, wherein the second spring-damper element is adapted to displace the door leaf into the open position in a decelerated manner. The disposition of the closing device at the door leaf results in the closing device moving along with the door leaf and being able to be disposed within the profiles. Thus, a visually appealing and compact solution can be achieved, in which the closing device is not visible for the user of the sliding door. Utilizing a second spring-damper element allows for displacing the door leaf, in a decelerated manner, into both the open position and the closed position.

An advantageous embodiment of the invention is achieved, if the first and the second spring-damper elements are disposed on a carrying body. A modular set is thereby created that allows for a quick installation with new sliding doors and for retrofitting with existing sliding doors.

In one embodiment, the door leaf has a cut-out in which the closing device is disposed. This allows for a compact arrangement of the closing device at the door leaf, wherein the closing device is covered by the existing profiles such that retrofitting existing sliding doors is possible without having to exchange the profiles.

Disposing the closing device between two carriages of a sliding door allows for utilizing the closing device for narrow and for wide sliding doors. In this case, the cut-out is always located in the center of the door leaf and, depending on the door width and the opening width, the carriages are moved to the outside towards the border of the door leaf.

In one embodiment, the carrying body has at least one reception for being attached to the door leaf such as to be able to mount the closing device to the door leaf at minimum installation expense.

A U-shaped or fork-shaped configuration of the receptions allows for hanging it into the cut-out in the door leaf such as to facilitate a very quick and simple installation and fastening by two clamping screws.

Each spring-damper element has a catch that cooperates with an associated release which are disposed in the guiding profile. The closing-damping function can thus be adjusted separately and independently from each other for the open position and the closed position. An individual adjustment is likewise achieved in that the releases can be shifted within the guiding profile in displacement direction of the door leaf.

In order to allow for clearly distinct the adjustment of the closing device for the open position and the closed position, the catches are disposed to be offset in height. Another advantageous solution is achieved in that at least one limit stop, which cooperates with a carriage, is disposed in the roller rail profile. Here again, a solution for an impact protection is made possible, which is invisible for a user of a sliding door.

BRIEF DESCRIPTION OF DRAWINGS

Hereinafter, further measures enhancing the invention will be illustrated in more detail in conjunction with the description of one preferred embodiment of the invention based on the Figures, in which.

DETAILED DESCRIPTION OF DRAWINGS

Figure 1:
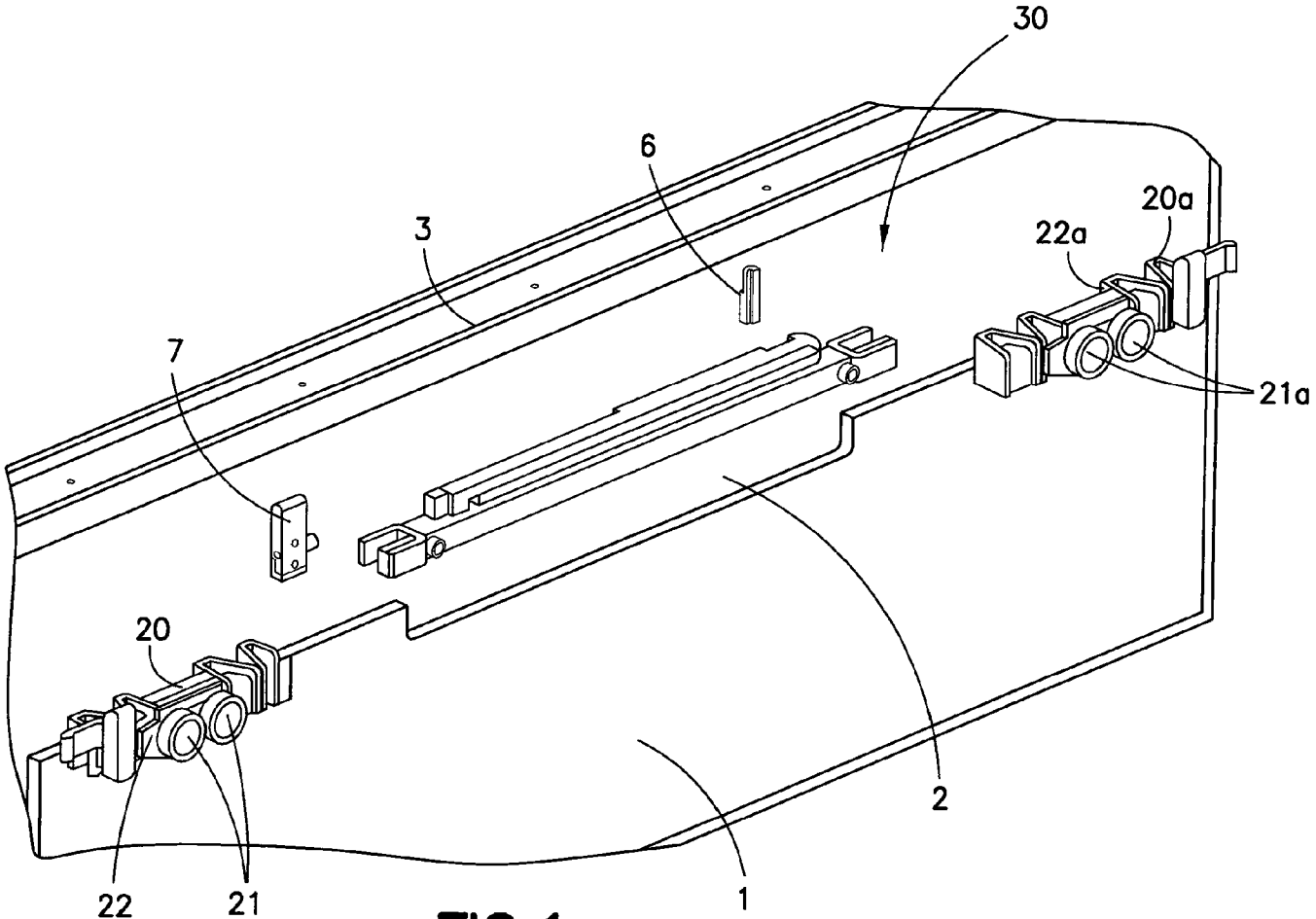
FIG. 1: is an illustration of the entire door leaf with the closing device.

The inventive sliding door, which consists of a door leaf 1 with a carriage 20, 20*a* and a closing device 30, is illustrated in FIG. 1. A guiding profile 3 with a roller rail profile 4, at which the door leaf 1 is guided to be displaceable by carriages 20, 20*a*, is attached to a wall 5 or a ceiling. The door leaf 1 may consist of glass, wood or another optional material. The one or more carriages 20, 20*a* essentially consist of a carrier 22, 22*a*, at which the carrying rollers 21, 21*a* are disposed, which roll on a non-illustrated running path of the roller rail profile 4. The door leaf 1 is attached to the carrier 22, 22*a* by a clamping device or an attachment device. A closing device 30, which is likewise attached to the door leaf 1, is disposed between the carriages 20, 20*a*. The door leaf 1 has a cut-out 2 for this purpose, into which the closing device 30 is recessed. Without the cut-out 2, the closing device 30 would have to be disposed above or next to the door leaf 1 in the area of the guiding profile 3 and roller rail profile 4, whereby the height and/or depth of the profiles would have to be dimensioned larger. Disposing the closing device 30 in a cut-out 2 of the door leaf 1 allows for retrofitting existing sliding doors without having to install new profiles, which otherwise would result very often in having to touch up or to renovate the ceiling or wall cladding. In comparison to known stationary closing devices, which are disposed in wall profiles or ceiling profiles or in depressions of the floor, the inventive closing device 30 moves along with the door leaf 1.

Figure 2:
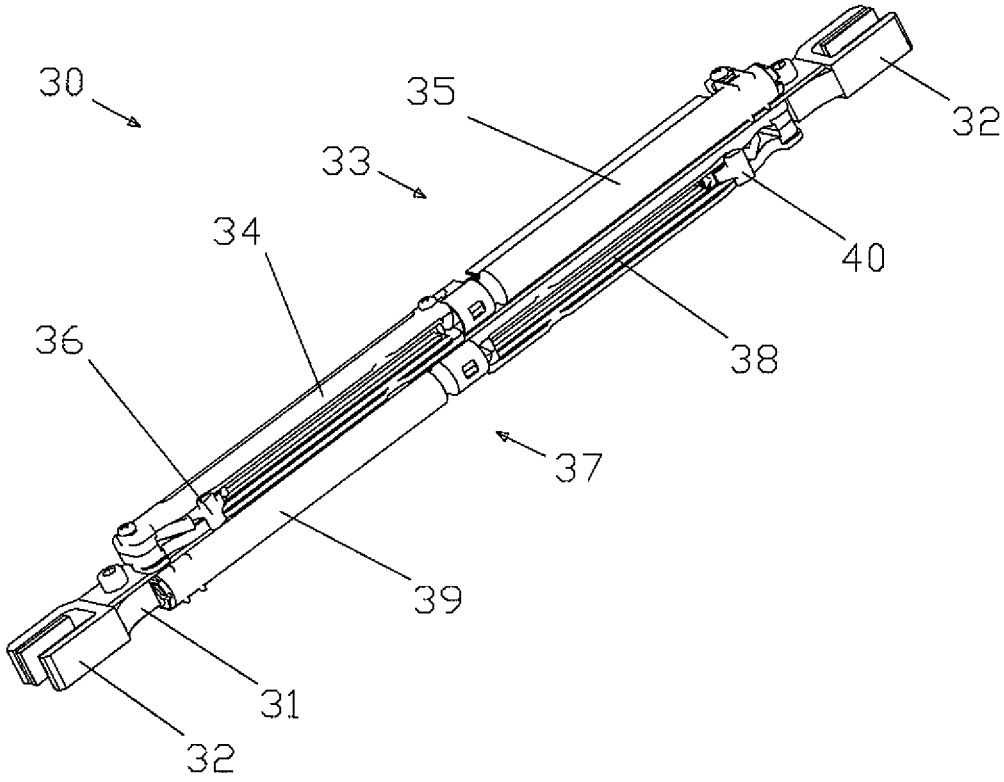
FIG. 2: is a perspective illustration of the closing device.

It can be seen in FIG. 2 that the closing device 30 comprises a carrying body 31, at which a first and a second spring-damper element 33, 37 are disposed. Each spring-damper element 33, 37 has a spring 34, 38, a damper 35, 39 and a catch 36, 40. Usually a compression spring is utilized as the spring 34, 38, which brings a non-illustrated piston rod, projecting from the damper 35, 39, into a maximum extended position, in which the spring 34, 38 is relaxed. In a compressed position, the spring 34, 38 is maintained in a so-called parking position, until—by displacing the door leaf 1—a release 6, which is stationarily disposed in the guiding profile 3, actuates the catch 36, 40 and thus releases and relaxes the spring 34, 38. When the spring 34, 38 relaxes, it pushes, respectively accelerates the door leaf 1 into an open or closed position. Against the acceleration force acts a deceleration force of the damper 35, 39, which slows the door leaf 1 down, and thus the door leaf moves silently and shock-free into an open or a closed position.

The damper 35, 39 may be configured as a pneumatic or hydraulic damper, which has a piston disposed at a piston rod and is movably disposed within a cylinder. In this case, the damping action may be achieved in an upper and/or lower terminal position of the piston, in that a liquid or gaseous medium is compressed and/or displaced by the piston.

In order to achieve a closing and damping function in both directions of movement of the door leaf 1, two spring-damper elements 33, 37 are disposed to be counter-directional on the carrying body 31. A separate release 6 is stationarily disposed in the guiding profile 3 for each spring-damper element 33, 37. In this case, the releases 6 are disposed to be offset in height in the guiding profile 3, in order to exclude malfunctioning. It can be seen in FIG. 2 that the two catches 36, 40 are likewise disposed to be offset in height on one side of the closing device 30.

Respectively one limit stop 7, against which the carriages 20, 20*a* abut, is disposed for the open position, respectively the closed position in each roller rail profile 4, in order to prevent the door leaf 1 from impacting against a wall or against a stationary lateral panel.

At each end, the carrying body 31 has receptions 32 by which the carrying body 31 is fastened to the door leaf 1. In this embodiment, the receptions 32 are configured to be U-shaped or fork-shaped such that the closing device 30 can be recessed in the cut-out 2 of the door leaf 1 and be clamped to the door leaf 1 by non-illustrated fasteners.

Figure 3:
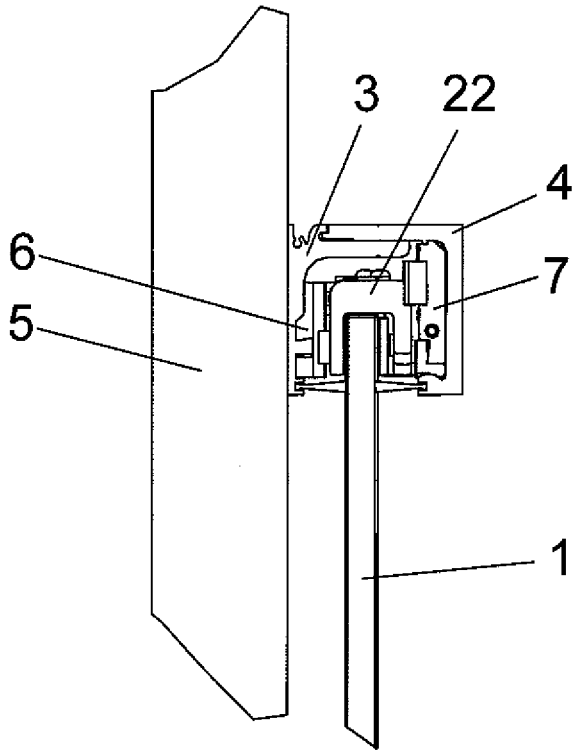
FIG. 3: is a lateral sectional illustration through the roller rail profile, with a view on a carriage.

In FIG. 3, a lateral sectional illustration through the roller rail profile 4 is shown, which allows for a frontal view on a carriage 20. The door leaf 1 is clamped in between the carrier 22 of the carriage 20 and, via the carrying rollers 21, transmits the weight of the door leaf via the roller rail profile 4 onto the guiding profile 3 and into the wall 5. A release 6, which cooperates with a catch (36 or 40) of the first or second spring-damper element 33, 37, is disposed in the guiding profile 3. At least one limit stop 7 is adjustably disposed in the roller rail profile 4. This illustration shows the compact arrangement of the closing device 30, which is disposed in alignment between the two carriages 20, 20*a*. This compact arrangement is exclusively made possible by the cut-out 2 in the door leaf 1, because otherwise the guiding profile 3 and the roller rail profile 4 would have to be considerably larger or else the closing device 30 would have to be disposed in a visible area.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A sliding door with a door leaf suspended from at least one carriage displaceably guided along a roller rail profile disposed at one of a wall and a ceiling, the sliding door includes a closing device configured to displace the door leaf into a closed position in a decelerated manner, the closing device disposed at the door leaf comprises:

a first spring-damper element including a first spring and a first damper; and a second spring-damper element including a second spring and a second damper, the second spring-damper element being disposed to be counter-directional to the first spring-damper element, wherein the first spring and first damper of the first spring-damper element cooperate to displace the door leaf into the closed position in a decelerated manner, and the second spring and second damper of the second spring-damper element cooperate to displace the door leaf into an open position in a decelerated manner.

2. The sliding door according to claim 1, further comprising a carrying body on which the first and the second spring-damper elements are disposed.

3. The sliding door according to claim 2, wherein at least one reception is disposed at the carrying body configured for attachment to the door leaf.

4. The sliding door according to claim 3, wherein the reception is configured to be one of U-shaped and fork-shaped.

5. The sliding door according to claim 1, wherein the door leaf has a cut-out in which the closing device is disposed.

6. The sliding door according to claim 1, wherein the door leaf is suspended from two carriages between which the closing device is disposed.

7. The sliding door according to claim 1, wherein each spring-damper element has a catch that cooperates with an associated release disposed in the rail profile.

8. The sliding door according to claim 7, wherein each release is shiftable within the rail profile in a direction of movement of the door leaf.

9. The sliding door according to claim 7, wherein the catches are configured to be offset in height.

10. The sliding door according to claim 1, wherein at least one limit stop cooperates with a carriage disposed in the roller rail profile.

* * * * *